United States Patent [19]

Culpepper, Jr.

[11] 3,932,137

[45] Jan. 13, 1976

[54] BURNER WITH AUTOMATIC HIGH-LOW OPERATION

[75] Inventor: Clifford Culpepper, Jr., Charlotte, N.C.

[73] Assignee: Aero-Dyne Manufacturing, Inc., Charlotte, N.C.

[22] Filed: Nov. 8, 1973

[21] Appl. No.: 413,770

[52] U.S. Cl. ..... 23/277 C; 110/8 A; 126/299 A; 126/299 R; 250/573; 250/574; 356/207; 431/79; 431/90; 431/12; 431/5; 431/DIG. 38

[51] Int. Cl.[2] ..... F23G 7/00

[58] Field of Search ..... 431/79, 90, 12, 5; 126/299 A, 299 R; 110/8 A; 250/573, 574; 356/207; 23/277 C

[56] References Cited

UNITED STATES PATENTS

| | | | |
|---|---|---|---|
| 1,755,970 | 4/1930 | Singleton | 431/79 |
| 2,874,763 | 2/1959 | Hobbs | 431/79 |
| 3,697,229 | 10/1972 | Frey et al. | 23/277 C |
| 3,796,550 | 3/1974 | Hall | 126/299 R X |

*Primary Examiner*—James H. Tayman, Jr.
*Attorney, Agent, or Firm*—Parrott, Bell, Seltzer, Park & Gibson

[57] ABSTRACT

Burner apparatus in which fuel and airborne combustible debris to be incinerated are received in a burner while fuel delivered to the burner is decreased in quantity in the absence of debris to be incinerated so that delivery of excess fuel in the absence of debris is avoided.

5 Claims, 5 Drawing Figures

BURNER WITH AUTOMATIC HIGH-LOW OPERATION

Recent efforts to control air pollution otherwise possibly occurring due to the release of airborne combustible debris have directed attention to the desirability of burners which receive fuel and the airborne debris and dispose of the debris by incineration. For certain air pollutants, such incineration is the preferred manner of control, notably in conjunction with certain food service operations typically employed in fast-service restaurants.

One difficulty heretofore encountered with certain burners for disposing of air pollutants has been unacceptably high fuel cost. Where this difficulty has been encountered, it usually has resulted from continuous delivery of the quantities of the fuel necessary to maintain a high intensity flame for incineration of the particular airborne combustible debris being controlled.

With the aforementioned difficulty and disadvantage particularly in mind, it is an object of the present invention to accomplish control over the delivery of excess fuel in the absence of debris to be incinerated. In realizing this object, through the apparatus of this invention, the quantity of fuel delivered to a burner is decreased in the absence of debris to be incinerated, responsive to a sensor which detects the presence of debris to be incinerated.

Some of the objects of the invention having been stated, other objects will appear as the description proceeds, when taken in connection with the accompanying drawings, in which.

The description which follows and the drawings to which the description refers set forth the best arrangements in accordance with this invention presently known to the inventor. However, it is contemplated that the specific arrangements hereinafter described may have more general utility and, in a broad range of applications, may be modified in some details. Accordingly, the description and illustrations are to be taken as broad teachings of this invention, rather than as restrictions upon the scope to which the invention is properly entitled.

Figure 1:
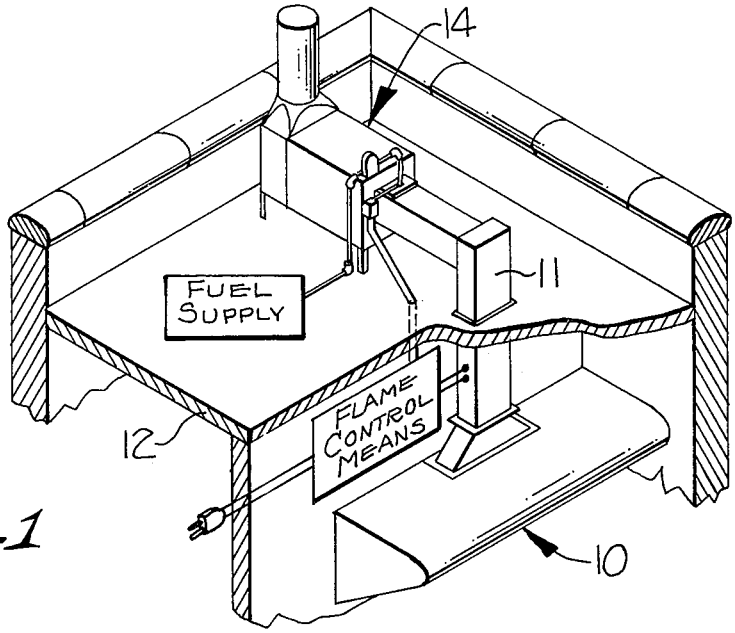
FIG. 1 is a perspective view, partly broken away, of an installation of apparatus in accordance with this invention.
Figure 2:
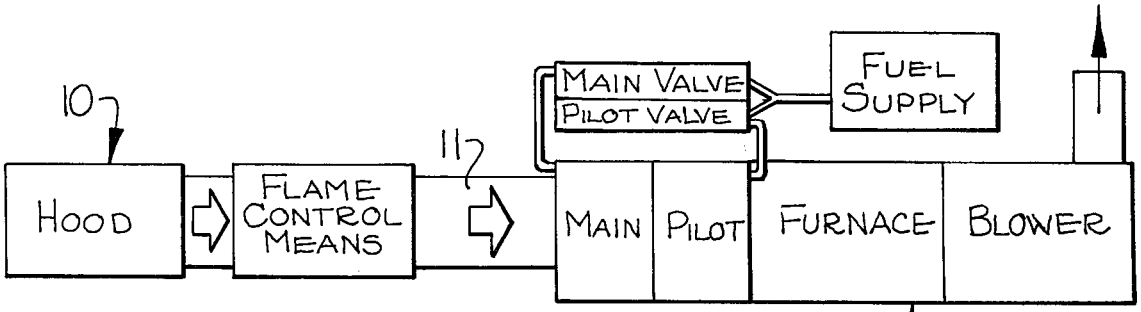
FIG. 2 is a schematic diagram of an arrangement in accordance with this invention.

Air pollutants created by certain fast-service restaurants typically are controlled by arrangements such as that illustrated in FIGS. 1 and 2, wherein a hood generally indicated at 10 overlies a cooking area such as a charbroiler. A flow of air is induced through the hood and through a duct 11 which typically rises through the roof 12 of a building enclosing the cooking area. The duct guides a flow of air withdrawn from the cooking area and airborne combustible debris such as grease particles entrained therewith. Outside of the building is located an incinerator device indicated at 14 which includes a combustion chamber and a burner disposed at the upstream end of the combustion chamber. A blower located downstream of the combustion chamber induces the flow of air and airborne combustible debris through the hood 10 and duct 11.

Figure 3:
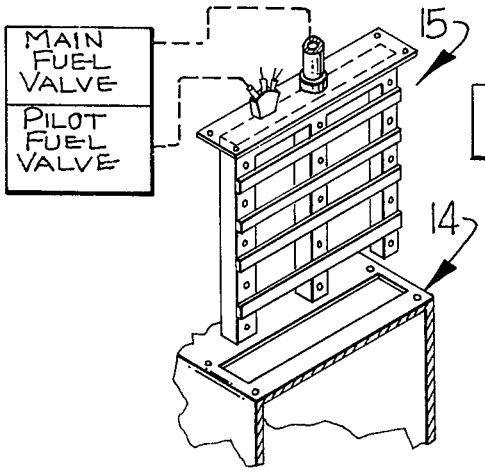
FIG. 3 is a partly perspective and partly schematic view indicating a detail of the arrangements of FIGS. 1 and 2.

Typically, the burner (more fully illustrated in FIG. 3 and there generally indicated at 15) is supplied with fuel from a suitable fuel supply (schematically illustrated in FIGS. 2 and 3). In accordance with certain operating embodiments of the apparatus in accordance with this invention, the fuel supply is a source of natural gas. In any event, fuel is supplied to the burner 15 through a main fuel valve as schematically illustrated in FIGS. 2 and 3. Where the fuel is natural gas, a pilot fuel valve typically supplies a pilot flame. As is known to persons familiar with gas fuel valves, provision is made for a flame-sensing device which detects the presence of the pilot flame and interrupts the delivery of fuel through the main fuel valve in event that the pilot flame is extinguished.

In accordance with this invention, the main fuel valve is placed under the control of a secondary flame control means schematically illustrated in FIG. 1. The flame control means is responsive to the presence of debris to be incinerated and cooperates with the main fuel valve for decreasing the quantity of fuel delivered to the burner in the absence of debris to be incinerated. Two specific forms for the flame control means are illustrated in FIGS. 4 and 5.

Referring particularly to the disposal of airborne combustible debris originating in a cooking area, it has been determined that the presence of such debris to be incinerated may be sensed by a photoelectric detection means mounted in predetermined relation to the duct 11 for sensing the optical density of the flowing stream of air and conveyed debris. Such an arrangement is illustrated in FIG. 4, where a light source 18 directs light across the duct 11 to a reflective surface 19, from which light returns to a photoelectric sensor 20. Upon the quantity of airborne combustible debris being conveyed dropping below a predetermined threshold level, the increase in light impinging on the photoelectric means 20 becomes sufficient to actuate the main fuel valve and decrease the fuel flow to only that amount required for the pilot flame. While FIG. 4 illustrates a photoelectric detection means which senses optical density of flowing air and conveyed debris within the duct 11, the invention contemplates also that the photosensitive means may be disclosed in the hood 10 or at the point of junction of the hood 10 with the duct 11.

Figure 4:
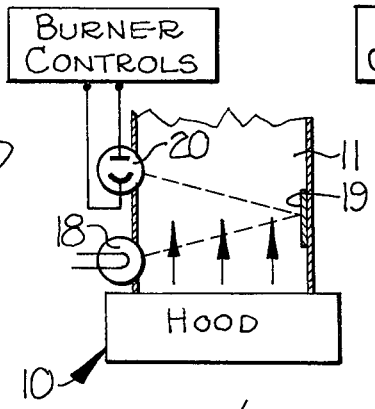
FIG. 4 is an elevation view, partly in section and partly schematic, illustrating one form of sensor in accordance with this invention.
Figure 5:
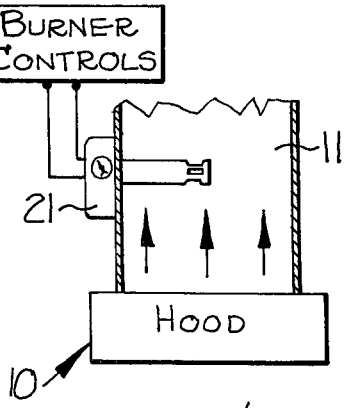
FIG. 5 is a view similar to FIG. 4, illustrating a second form of sensor in accordance with this invention.

In the context to which reference was had in describing the arrangement of FIG. 4, it has been determined that the presence and absence of conveyed debris influences the temperature conditions of the air flowing through the duct 11, particularly where the generation of airborne combustible debris results from active cooking operations performed beneath the hood 10. For this reason, and as illustrated in FIG. 5, a temperature sensing device 21 may be mounted within the duct 11 or hood 10 and employed in a manner similar to the photoelectric detection means of FIG. 4.

While described herein with particular reference to a main fuel valve arrangement in which the reduction of fuel flow does not interrupt the delivery of the small quantity of fuel required to maintain a pilot flame, this invention also contemplates that the reduction of fuel flow in the absence of debris to be incinerated may involve the cessation of fuel delivery in circumstances where the burner control makes provision for automatic reignition.

In the drawings and specification, there has been set forth a preferred embodiment of the invention, and although specific terms are employed, they are used in a generic and descriptive sense only and not for purposes of limitation.

That which is claimed is:

1. In an arrangement for incinerating combustible debris and having means for entraining combustible debris in a flowing stream of air including fan means for inducing a flow of air and duct means for guiding the flowing stream of air and the combustible debris entrained therewith, means for supplying fuel, and burner means operatively communicating with said fuel supply means for receiving fuel therefrom and operatively interposed in said duct means for passage of the flowing stream of air and entrained debris therethrough and for disposal of entrained debris by burning, an improvement which facilitates economical operation in disposal of intermittently varying quantities of debris and comprising means for distinguishing between concentrations of conveyed entrained debris in said duct means above and below a threshold concentration and including sensing means for detecting upstream of said burner means the presence in the flowing stream of air of conveyed entrained debris, and fuel control means interposed between said fuel supply means and said burner means and operatively connected with and responsive to said concentration distinguishing means for varying the quantity of fuel delivered to the burner means in response to distinguished concentrations of conveyed entrained debris whereby the fuel required to dispose of the debris is delivered only as needed and excessive fuel usage is avoided during periods when the concentration of conveyed debris is below the threshold concentration.

2. An arrangement according to claim 1 wherein said sensing means comprises photoelectric detection means mounted for sensing the optical density of the flowing stream of air and conveyed entrained debris passing through said duct means and toward said burner means.

3. An arrangement according to claim 1 wherein said sensing means comprises temperature detection means mounted for sensing the temperature of the flowing stream of air and conveyed entrained debris passing through said duct means and toward said burner means.

4. An arrangement according to claim 1 wherein said fuel control means responds to said concentration distinguishing means for decreasing the quantity of fuel delivered to said burner means in the absence of debris to be incinerated.

5. An arrangement according to claim 1 wherein said fuel control means responds to said concentration distinguishing means for increasing the quantity of fuel delivered to said burner means in the presence of debris to be incinerated.

* * * * *